US005967076A

United States Patent [19]

Tinnen

[11] Patent Number: 5,967,076

[45] Date of Patent: Oct. 19, 1999

[54] DEVICE FOR EMERGENCY TOWING OF VESSELS

[76] Inventor: Gunnar Tinnen, Reppevn. 90, N-7053 Ranheim, Norway

[21] Appl. No.: 08/952,696

[22] PCT Filed: Jun. 7, 1996

[86] PCT No.: PCT/NO96/00138

§ 371 Date: Feb. 23, 1998

§ 102(e) Date: Feb. 23, 1998

[87] PCT Pub. No.: WO96/41742

PCT Pub. Date: Dec. 27, 1996

[30] Foreign Application Priority Data

Jun. 9, 1995 [NO] Norway ..... 952285

[51] Int. Cl.[6] ..... B63B 21/16

[52] U.S. Cl. ..... 114/254; 242/396.5

[58] Field of Search ..... 114/254, 253, 114/179, 180, 199; 242/396.5, 396.9

[56] References Cited

U.S. PATENT DOCUMENTS

| | | | |
|---|---|---|---|
| 3,494,443 | 2/1970 | Huffhines | 114/254 |
| 3,780,989 | 12/1973 | Peterson | 254/173 A |
| 4,455,961 | 6/1984 | Hansen et al. | 114/254 |
| 4,597,352 | 7/1986 | Norminton | 114/254 |
| 4,846,313 | 7/1989 | Sharp | 188/187 |
| 5,263,431 | 11/1993 | Wood | 114/254 |
| 5,609,120 | 3/1997 | Eronen | 114/253 |

*Primary Examiner*—Sherman Basinger
*Assistant Examiner*—Patrick Muldoon
*Attorney, Agent, or Firm*—Melvin A. Hunn

[57] ABSTRACT

A device for emergency towing of vessels. The device has a structure and function for storage where active parts are protected against adverse external influence, thereby making the device ready for use without the risk of jamming or other malfunctions. The device can be easily and rapidly activated, and the towing wire can be extended even on a dead ship. The device includes a braking arrangement in which the braking of the towing wire can be conducted with an increasing braking effect, from no braking to complete braking of the extended towing wire.

16 Claims, 5 Drawing Sheets

DEVICE FOR EMERGENCY TOWING OF VESSELS

The invention relates to an emergency towing device for ships, particularly large ocean vessels, including tankers, as stated in the introduction to claim 1.

BACKGROUND

With increasing seabound transport of oil and similar products, the requirement for safety measures to avoid contamination in disasters is increasing. It is now required that larger vessels have to be provided with emergency towing facilities, which can be operated on a "dead" ship, when other equipment is not operating.

There are several known ways of storing emergency towing wires. One of these is a winch drum arranged at the ships side with a wire guided though a hawsehole, and ready for extension. The exposed wire end is inappropriate for equipment which is in a state of readiness a long time. Additionally, the braking systems of known winch drums have not been satisfactory. None of the prior art has allowed an easy initial extension and heavy braking at the end of the uncoiling operation.

OBJECTS

The main object of the invention is to provide a device for emergency towing, eliminating the above shortcomings in the prior art as far as possible.

It is desirable to have a device with a satisfactory structure and function for storage where active parts are protected against adverse external influence. The device must be ready for use, without the risk jamming or other malfunctions.

Further, it is an object to provide a device which is simple to use, i.e. with easy and rapid activation and extension of the wire on a "dead" ship.

It is also an object to provide a braking arrangement in which the braking of the wire can be conducted with an increasing braking effect, from no breaking to complete braking of the extended wire.

THE INVENTION

The basic improvements are provided with a device as stated in claim 1. Various features and details of this device will appear in the below description of an embodiment below.

In claims 2–10, additional features of the invention are stated.

EXAMPLE

The invention is described further with reference to the drawings, in which

Figure 1:
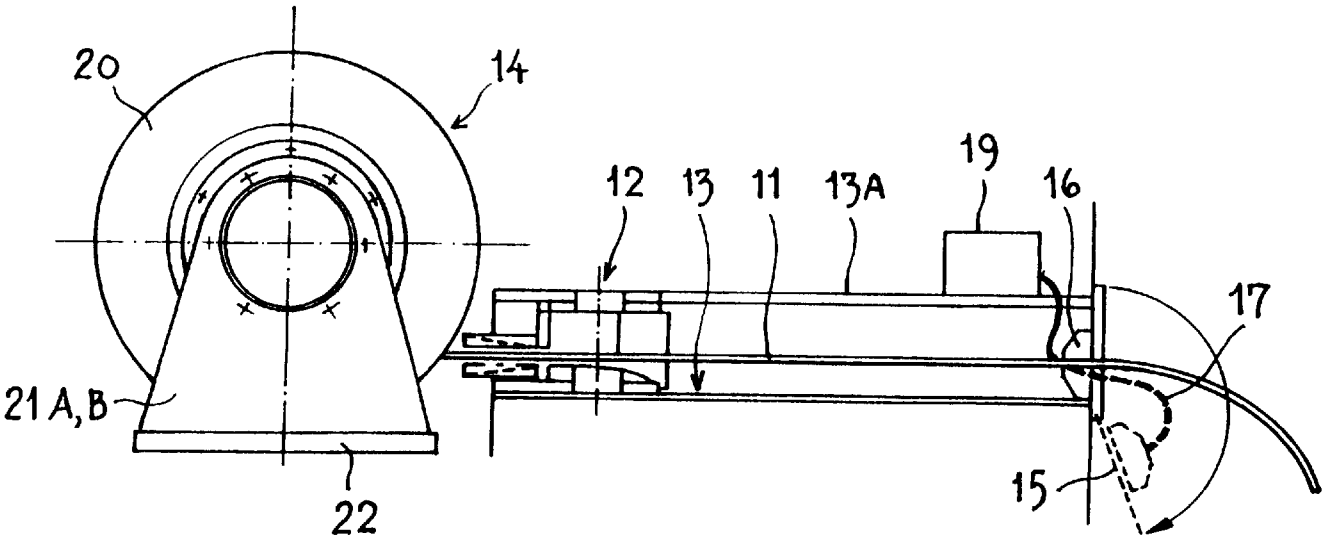
FIG. 1 shows a side view of a device according to the invention.
Figure 2:
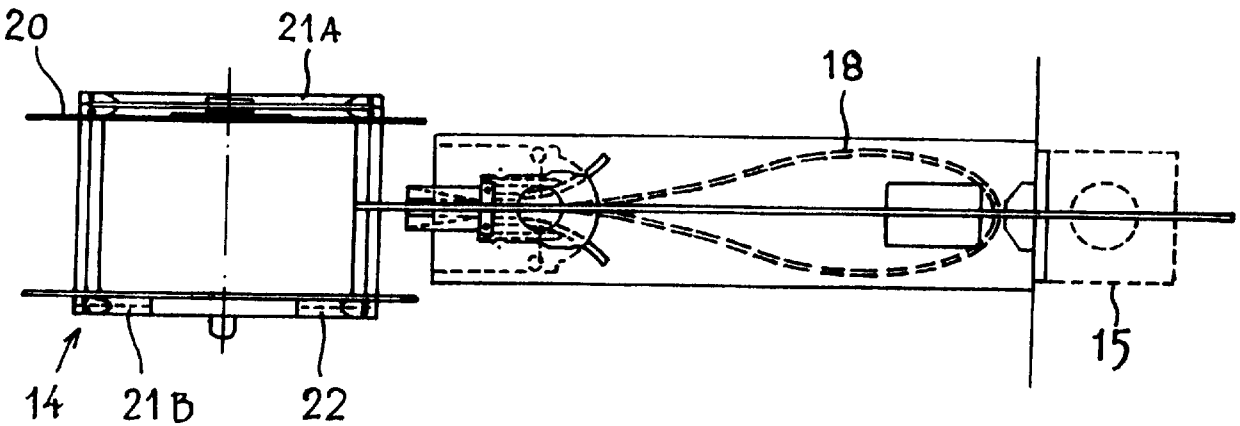
FIG. 2 shows a plan view of the deveice in FIG. 1.
Figure 3:
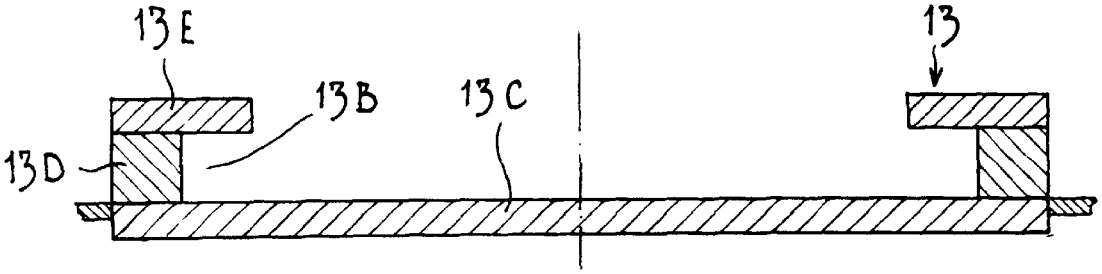
Figure 4:
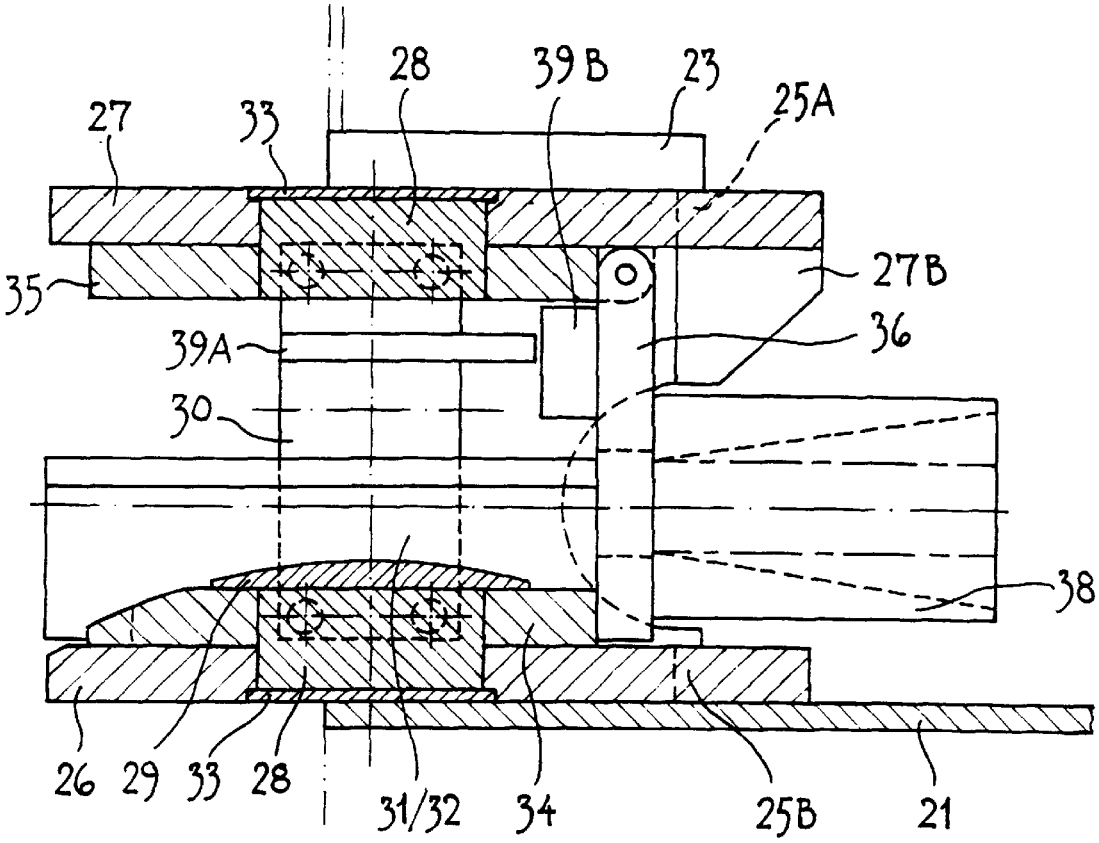
Figure 5:
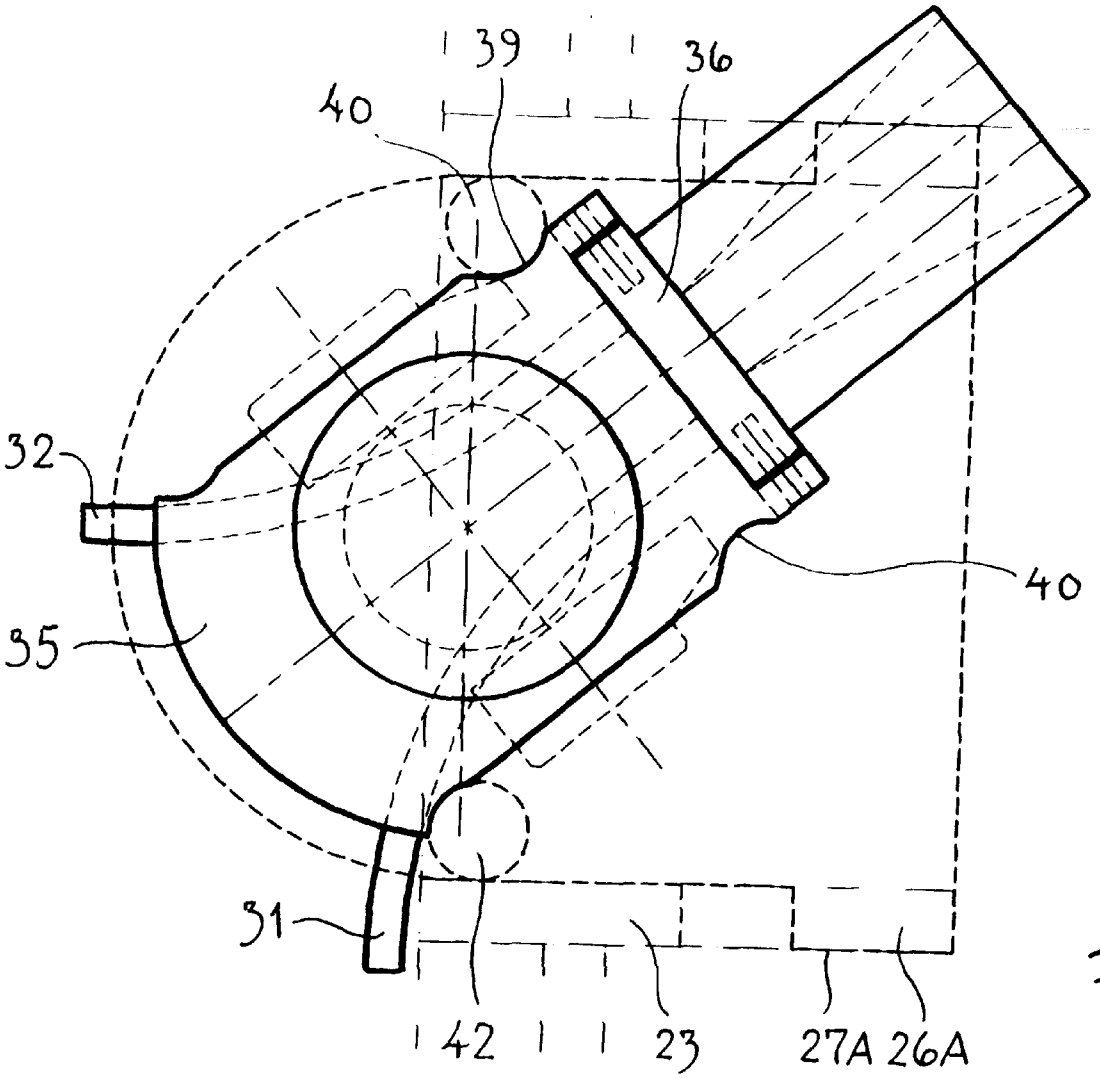
Figure 6:
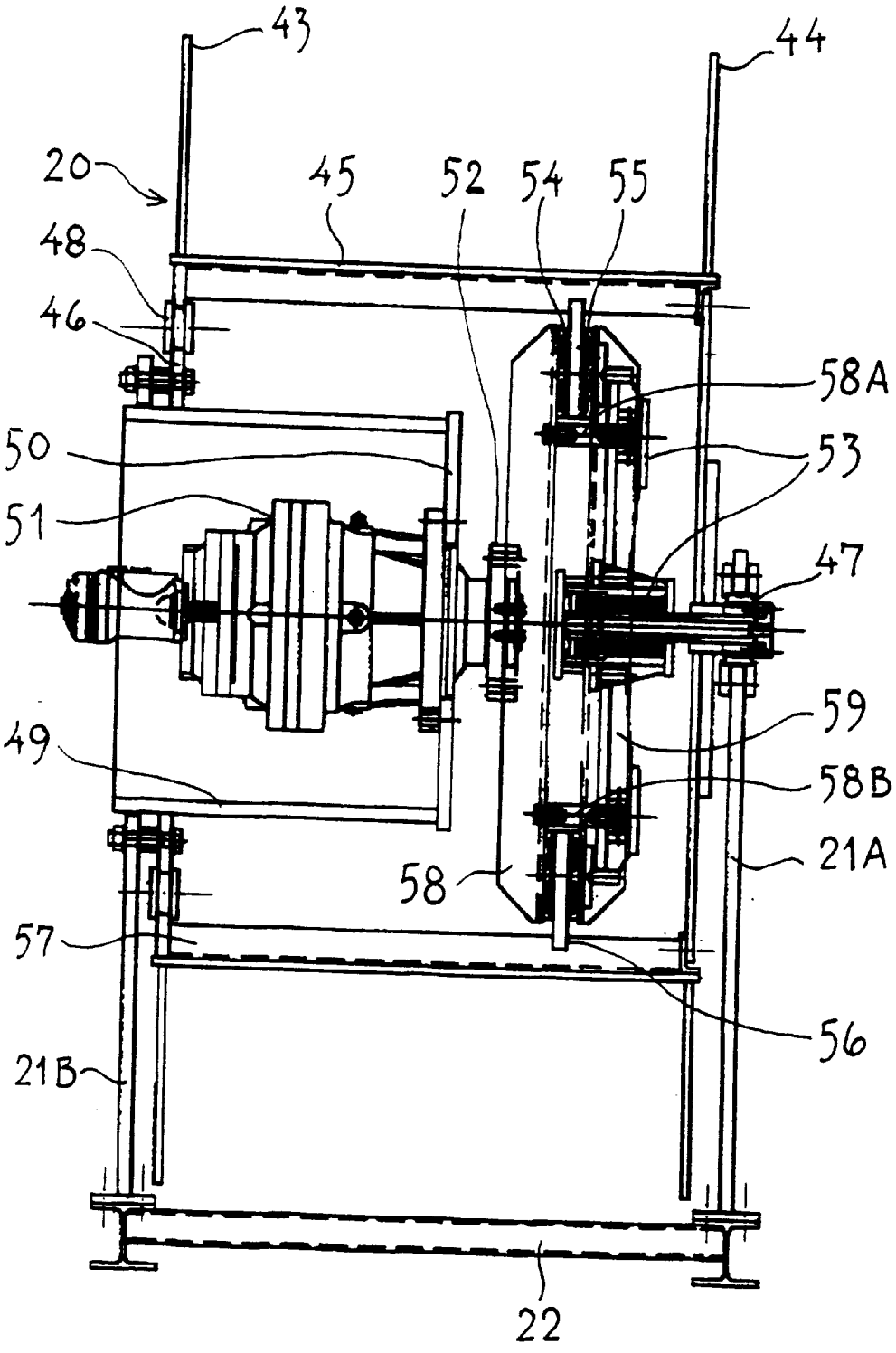
Figure 7:
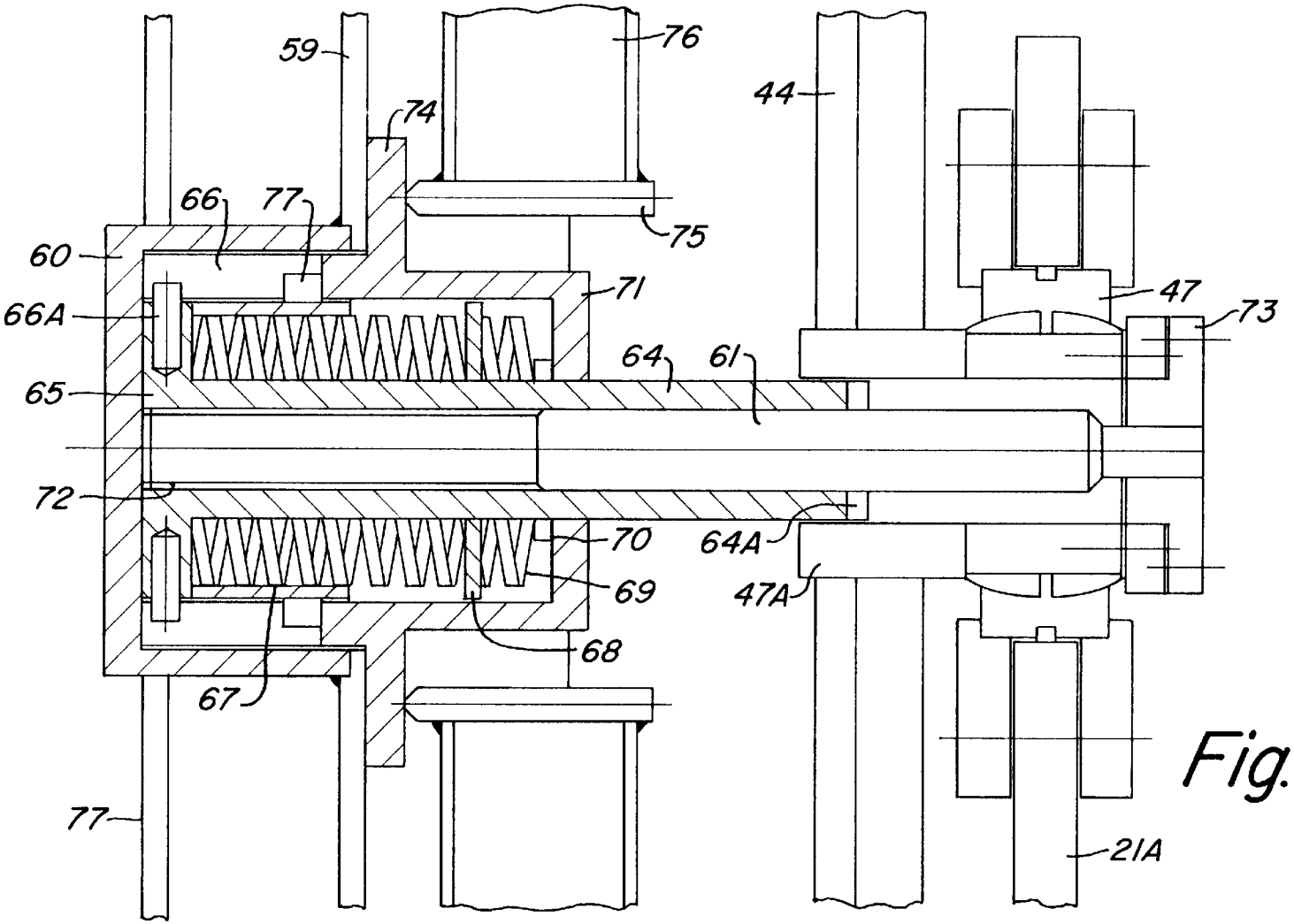

FIG. 3 shows a section through a guiding rail of the device in FIGS. 1 and 2, FIG. 4 shows a side view, partly in section, of the hawsehole for guiding the wire in FIG. 3, FIG. 5 shows a plan view from above of the hawsehole of FIG. 4, FIG. 6 shows a side view, partly in section, of the storage unit of FIGS. 1 and 2, while FIG. 7 shows an axial section of the braking device of the storage unit in FIG. 6.

FIGS. 1 and 2 show a device for the emergency towing of ships. For safety reasons, it is required that each ship is provided with such a device. The device according to the example comprises four main parts: a towing wire 11, a hawsehole 12 which is guided on a pair of guiding rails 13, and a storage unit 14 for the wire when it is not in use. The storage unit 14 also serves to pull in the wire after use or testing. The storage unit 14 is preferably provided with a motor which will be described further, but it may also be provided without a motor, but be operable by a mobile motor.

The guiding rails 13 are mounted on the ships deck, perpendicularly to the ships side. In the example, the guiding rails are enclosed by an enclosure 13A in the shape of a channel, which has a cover 15 hinged at the lowermost side of the end of the enclosure at the ships side. The cover 15 has provision (not shown) on its internal side, for holding a buoy 16 which is attached to the end of the wire 11 with a line 17. The end of the wire 11 has a loop 18 (which is placed in the enclosure 13A when the wire is pulled in) to protect it against esternal conditions. The line 17 is coiled up in a container 19 placed at the outer end of the enclosure 13A.

The guiding rails 13 can alternatively be arranged under the ships deck, to avoid the need for an enclosure.

The storage unit 14 for the wire 11 has a wiredrum 20 positioned between two brackets 21A and 21B which extends from a socket mounted on the deck behind the guiding rails 13. The storage unit will be described in more detail with reference to FIGS. 6 and 7.

FIG. 3 shows a section through the guiding rails 13 which are mounted directly on the ships deck 13C. Two carrying rails 13D are provided which have a mutual distance corresponding to the width of the hawsehole 12 (see below). Over each of the carrying rails a top rail 13E protrudes inward from the carrying rails 13D and defines a groove 13B for guiding the hawsehole 12, as described below.

FIG. 4 shows a vertical section lengthwise through the hawsehole 12 in extended position, with an inner part engaging the guiding rails 13 and an outer part engaging a pair of side walls 23. The side walls are provided with recesses 25A and 25B to hold the hawsehole 12 vertically and horizontally. These are secured by side wall ds lugs 26A, 27A (FIG. 5). The inner part of the hawsehole is pivotable, for turning as shown in FIG. 5.

The hawsehole 12 comprises a bottom disc 26 and a top disc 27 which are locked to the sidewalls 23. The bottom disc 26 and the top disc 27 are connected to a pivotable part with bushes 28A, 28B at the top and at the bottom, respectively. The ends of the bolts 28A and 28B are covered by discs 33 on the outer side of the top disc 27 and the bottom disc 26.

The pivotable part of the hawsehole 12 is comprised of a bottom entrance element 34 with a curved front, as well as a curved cover disc 29, both rotating around the bottom 28B. The bottom part is welded to two baffles 31, 32 being substantially arc shaped and converging toward a cover 36. The cover 36 has an opening for the towing wire 11. The top part consists of a pivoting coverpiece 35 to the inner edge of which is hingedly connected cover 36 for locking the towing wire 11. The top and the bottom parts are connected with a pair of side elements 30. The side elements 30 are carrying a guiding lug 39A and the cover is provided with a block 39B for guiding the towing wire 11. The towing wire 11 is carrying a stop element 38 which at complete extension engages the cover 36 posiitoned on the discs 34 and 35.

FIG. 5 shows recesses 39 and 40 on both sides of the pivotable pieces 34, 35, the purpose of which is to engage two vertical stop rods 41, 42. The stop rods 41, 42 thus restrict the sideways pivoting of the hawsehole.

In FIG. 6, the storage unit 14 is shown in more detail. The storage unit 14 comprises the wire drum 20, to store the towing wire 11, and which can pull in the wire after use or testing.

The wire drum 20 has two side flanges 43 and 44 on a tubular drum core 45. One side the drum 20 is carried by side bracket 21A. A spherical bearing 47 is carried by bracket 21A. On the other side bracket 21B carries a tubular motor case 49 with an inward flange 50 at the inner end, which carries a hydraulic coiling motor 51 with an integrated reduction gear having an inward driving flange 52. The driving flange 52 is connected to the driving part of a combined friction clutch and braking device 53. The friction clutch has two pairs of friction or braking discs 54 and 55 positioned at the ends of a pair of driving arms 58, 59. Braking discs 55 are carried and moved by a pair of braking arms 76 which will be described in more detail in FIG. 7. An annular braking element or clutch ring 56 is arranged between the brake discs. On its circumference it has four indents or notches evenly distributed (not shown), to engage four corresponding axial ribs 57 inside the drum 45. The ribs 57 may be L-profile steel rods welded to the drum. By arranging the braking element so it is axially movable, it will be self centering.

The driving flange 52 is connected to the adjacent driving arm 58, which is manufactured of a U-profile element with a carrying disc facing the flange 52.

In an alternative embodiment not shown, the storage unit lacks a permanent coiling motor. The case 49 may then be extended to the adjacent driving arm 58 and attached thereto, e.g. with a rotatable journaled flange. When coiling the wire, a mobile motor or power unit to be temporarily attached to the rotatable journalled flange must be provided.

The second driving arm 59 is carried by pin bolts 58A and 58B extending axially from the first driving arm radially inwardly to the braking discs 54, 55.

The motor case 49 carries an annular flange 46 being attached by bolts to the side bracket 21B. The annular flange 46 is also a trust element for journalling one of the side flanges 43 of the storage drum 20. The journalling comprises rollers 48 distributed around the circumference og the storage drum 20.

In FIG. 7 the central parts of the braking device 53 are shown. It comprises a hub 60 welded to the driving arm 59. The hub 60 is cup shaped and is journaled on an internal cup 65, the hub being provided with a pair of juxtaposed axial grooves 66 on the inner side, mated with two corresponding guiding pins 66A threaded into the external side of cup 65. The cup 65 comprises an annular flange at the end of a tightening bushing 64 which is carried by the bearing 47 and which at its free end has a groove 64A for a pipe tool. At the cup end the tightening bushing 64 is provided with internal threads 72 engaging a threaded mandrel 61. The mandrel 61 is at the external end permanently engaged with a cover 73 fastened with screws (not shown) and rotates with the storage drum 20, being attached to a bushing 47A carrying the side flange 44 with threads, and engaging the bottom of the hub 60 with its inner end.

Upon rotation of the mandrel 61 in a direction corresponding to the uncoiling of the wire wire on drum 20, cup 65 is moved into a cup 71. It then forces a disc spring 67 on the bushing 64, engaging the bottom of the cup 65. With a washer 68 as an intermediate element to an axally shorter and more rigid disc spring 69, it forces a washer 70 against the bottom of the cup 71 facing the first cup 65. The cup 71 is provided with a pair of radially extending, external wings 74 engaging the inner ends 75 of a pair ofjuxtaposed braking arms 76 being connected to the second driving arm 59 and acting as a lever arm against one of the sets of braking discs 55. (FIG. 6). The details of the lever arm system is based on commonly known technology and no further description is included.

If the rotation of the wire drum continue until the pins 66A are released from the grooves 66, in an annular groove 77 at the free end of the grooves, it may be entered into engagement by removing the cover 73 and turning the mandrel 61. The bushing 64 may be locked by a tubular tool (not shown). Alternatively the disc springs 67 and 69 are dimensioned to stop the rotation of the wire drum before the pins are disengaged.

The drum 20 can be used for purposes other than storing wire for emergency towing, e.g. for storing fire hoses or for storing wires for other purposes. Generally it can be used for storing lines, wires, flexible tubes and similar elements, which need a controlled uncoiling and braking operation. This may be carried out regardless of the presence of a motor or external power by manual coiling.

The purpose of the more rigid disc spring 69 is to provide the necessary force from the braking discs 54 and 55 to ensure the rotation of the wire drum 20 under all conditons. To have full braking effect, the mandrel 61 should be tightened manually, after the driving equipment has been engaged for coiling in the wire. After coiling in, the mandrel 61 has to be released manually to allow free rotation of the wire drum 20 at the start of the uncoiling.

The hub 60 is guided by pins (not shown) fastened to the braking arms 76.

I claim:

1. A device for the emergency towing of ships comprising:

a storage drum for storing a towing wire;

a hawsehole arranged at the side of the ship for guiding the towing wire;

a guide element disposed between an outer active position and an inner position, the guide element being disposed a distance from the side of the ship; and an internal frictional brake carried by the storage drum, the internal friction brake being progressively activated by a threaded device and being operated by the extension of the wire;

wherein the hawsehole is movable along the guide element between the outer active position and the inner position; and wherein the device is disposed internally to the ship.

2. A device for the emergency towing of a ship, the device comprising:

a storage drum for storing a towing wire;

a hawsehole arranged at a side of the ship for guiding the towing wire;

a guide element disposed between an outer active position and an inner position, the guide element being disposed a distance from the side of the ship; and an internal frictional brake carried by the storage drum, the internal friction brake being progressively activated by a threaded device and being operated by the extension of the wire;

wherein the hawsehole is movable along the guide element between the outer active position and the inner position, and wherein the hawsehole is journalled in the guide element to provide for pivoting around a vertical axis at the outer active position.

3. A device for the emergency towing of a ship, the device comprising:

a storage drum for storing a towing wire;

a hawsehole arranged at a side of the ship for guiding the towing wire;

a guide element disposed between an outer active position and an inner position, the guide element being disposed a distance from the side of the ship;

an internal frictional brake carried by the storage drum, the internal friction brake being progressively activated by a threaded device and being operated by the extension of the wire;

a pair of guiding rails selectively arranged on a deck of the ship; and a wire endloop disposed internal to the side of the ship;

wherein the hawsehole is movable along the guide element between the outer active position and the inner position; and wherein the hawsehole is journalled on the guiding rails, and the device, in a retracted position, can hold the wire endloop internal to the side of the ship.

4. A device for the emergency towing of a ship, the device comprising:

a storage drum for storing a towing wire;

a guide element disposed between an outer active position and an inner position, the guide element being disposed a distance from a side of the ship;

a hawsehole arranged at the side of the ship for guiding the towing wire, the hawsehole having two converging baffles carried by vertical pivoting pins engaging a bottom disc and a top disc, respectively, the bottom disc engaging the guide element; and an internal frictional brake carried by the storage drum, the internal friction brake being progressively activated by a threaded device and being operated by the extension of the towing wire;

wherein the hawsehole is movable along the guide element between the outer active position and the inner position.

5. A device for the emergency towing of a ship, the device comprising:

a storage drum for storing a towing wire;

a hawsehole arranged at a side of the ship for guiding the towing wire;

a guide element disposed between an outer active position and an inner position, the guide element being disposed a distance from the side of the ship; and an internal frictional brake carried by the storage drum, the internal frictional brake having an annular clutch ring with at least one notch at its circumference, the notch engaging corresponding internal axial ribs of the storage drum, the internal frictional brake being progressively activated by a threaded device and being operated by the extension of the towing wire;

wherein the hawsehole is movable along the guide element between the outer active position and the inner position.

6. The device according to claim 5, further comprising:

a pair of braking arms operating as lever arms;

two pairs of braking discs arranged adjacent to each side of the clutch ring, one pair of the braking discs disposed on each arm at a selected predetermined distance; and a bushing operated by threads and being arranged centrally in the internal frictional brake;

wherein the braking discs are operated by the bushing through the lever arms.

7. The device according to claim 6, further comprising:

an axially fixed hub;

a rotatable mandrel with external threads; and an activating element with protruding wings;

wherein the inner ends of the braking arms are attached to the axially fixed hub;

wherein the braking arms are journalled to force the braking discs closed; and wherein the inner ends of the braking arms are displaced by axial guiding of the threaded bushing during rotation of the storage drum by the rotatable mandrel, thereby forcing the activating element to engage the inner ends of the braking arms.

8. The device according to claim 7, further comprising:

a spring disposed between the threaded bushing and the activating element.

9. The device according to claim 8, wherein the rotatable mandrel is coupled to the bushing by a cover.

10. The device according to claim 9, further comprising:

a pair of engaging grooves; and a pair of guide pins disposed in the engaging grooves;

wherein the bushing is rotationally locked to the axially fixed hub by the pair of engaging grooves and the guide pins.

11. A device for the emergency towing of a ship, the device comprising:

a storage drum for storing a towing wire;

a hawsehole arranged at a side of the ship for guiding the towing wire;

a guide element disposed between an outer active position and an inner position, the guide element being disposed a distance from the side of the ship; and an internal frictional brake carried by the storage drum, the internal friction brake being progressively activated by a threaded device and being operated by the extension of the towing wire;

wherein the hawsehole is movable along the guide element between the outer active position and the inner position, the hawsehole being provided for guiding the towing wire in directions oblique to the side of the ship.

12. The device according to claim 11, further comprising:

an annular clutch ring with at least one notch at its circuference;

a pair of braking arms operating as lever arms;

two pairs of braking discs arranged adjacent to each side of one pair of the braking discs disposed on each arm at a selected predetermined distance; and a bushing operated by threads and being arranged centrally in the friction brake;

wherein the braking discs are operated by the bushing through the lever arms.

13. The device according to claim 12, further comprising:

an axially fixed hub;

a rotatable mandrel with external threads; and an activating element with protruding wings;

wherein the inner ends of the braking arms are attached to the axially fixed hub;

wherein the braking arms are journalled to force the braking discs closed; and wherein the inner ends of the braking arms are displaced by axial guiding of the threaded bushing during rotation of the storage drum by the rotatable mandrel, thereby forcing the activating element to engage the inner ends of the braking arms.

14. The device according to claim 13, further comprising:

a spring disposed between the threaded bushing and the activating element.

15. The device according to claim 14, wherein the rotatable mandrel is coupled to the bushing by a cover.

16. The device according to claim 15, further comprising:

a pair of engaging grooves; and a pair of guiding pins disposed in the engaging grooves;

wherein the bushing is rotationally locked to the axially fixed hub by the pair of engaging grooves and the guiding pins.

* * * * *